US009419380B2

(12) United States Patent
Sharf et al.

(10) Patent No.: US 9,419,380 B2
(45) Date of Patent: Aug. 16, 2016

(54) PLUGGABLE MODULE FOR A COMMUNICATION SYSTEM

(71) Applicant: Tyco Electronics Corporation, Berwyn, PA (US)

(72) Inventors: Alex Michael Sharf, Harrisburg, PA (US); Steven David Dunwoody, Middletown, PA (US); Richard James Long, Columbia, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/599,025

(22) Filed: Jan. 16, 2015

(65) Prior Publication Data

US 2016/0211620 A1 Jul. 21, 2016

(51) Int. Cl.
*H01R 13/648* (2006.01)
*H01R 13/6581* (2011.01)
*H01R 13/66* (2006.01)

(52) U.S. Cl.
CPC ..... *H01R 13/6581* (2013.01); *H01R 13/665* (2013.01)

(58) Field of Classification Search
CPC ..... H01R 13/6581; H01R 13/665; H01R 12/724; H01R 13/65802
USPC ..... 439/607.01
See application file for complete search history.

(56) References Cited

U.S. PATENT DOCUMENTS

| | | | | |
|---|---|---|---|---|
| 7,074,082 | B2 | 7/2006 | Kerlin et al. | |
| 8,328,565 | B2 | 12/2012 | Westman et al. | |
| 2011/0300749 | A1* | 12/2011 | Sytsma | H01R 13/65802 439/607.01 |
| 2013/0157499 | A1* | 6/2013 | Crippen | H01R 12/724 439/487 |

* cited by examiner

*Primary Examiner* — Jean F Duverne

(57) ABSTRACT

A pluggable module includes a pluggable body extending between a mating end and a cable end. The pluggable body has first and second ends with sides extending therebetween along a length of the pluggable body. The first end, second end and sides define a cavity. The pluggable body includes a plurality of fins extending outward from at least one of the first end, the second end and the sides. Channels are defined between the fins. The pluggable body has grid fins extending across the channels between adjacent fins. The pluggable module includes an internal circuit board held in the cavity. The internal circuit board is provided at an end of a cable communicatively coupled to the internal circuit board. The pluggable body is configured to be plugged into a receptacle assembly such that the internal circuit board is communicatively coupled to a communication connector of the receptacle assembly.

20 Claims, 4 Drawing Sheets

PLUGGABLE MODULE FOR A COMMUNICATION SYSTEM

BACKGROUND OF THE INVENTION

The subject matter described herein relates to a pluggable module for a communication system.

At least some known communication systems include receptacle assemblies, such as input/output (I/O) connector assemblies, that are configured to receive a pluggable module and establish a communicative connection between the pluggable module and an electrical connector of the receptacle assembly. As one example, a known receptacle assembly includes a receptacle housing that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable module is inserted through the opening and advanced toward the electrical connector in the cavity. The pluggable module and the electrical connector have respective electrical contacts that engage one another to establish a communicative connection.

One challenge often encountered in the design of the pluggable module and receptacle assembly is the heat generated during operation of the communication system, which negatively affects module/system reliability and electrical performance. Typically, heat is generated by components on the internal circuit board within the pluggable module and drawn away from the internal circuit board by the metal body of the pluggable module. In some cases, a heat sink that is held by the receptacle assembly housing in direct contact with the metal body of the pluggable module is used to transfer the heat from the pluggable module. Air flowing through and around the receptacle assembly transfers the heat that emanates from the pluggable module. As data throughput speeds of the pluggable modules increase, more heat is generated. Conventional designs are proving to be inadequate for the required heat transfer.

A further challenge in the design of the pluggable module and receptacle assembly is signal degradation due to electromagnetic interference (EMI). The receptacle housing is conductive and designed to reduce EMI along the signal paths. However, to reduce EMI, openings, slots, channels and other leakage areas are closed or eliminated, which reduces the amount of airflow through the receptacle housing available for heat dissipation.

Accordingly, there is a need for a pluggable module for use in a communication system that allows significant heat transfer and EMI reduction.

BRIEF DESCRIPTION OF THE INVENTION

In an embodiment, a pluggable module is provided including a pluggable body extending between a mating end and a cable end. The pluggable body has a first end and an opposite second end with sides extending therebetween along a length of the pluggable body. The first end, second end and sides define a cavity. The pluggable body includes a plurality of fins extending outward from at least one of the first end, the second end and the sides. Channels are defined between the fins. The pluggable body has grid fins extending across the channels between adjacent fins. The pluggable module includes an internal circuit board held in the cavity. The internal circuit board is provided at an end of a cable communicatively coupled to the internal circuit board. The pluggable body is configured to be plugged into a receptacle assembly such that the internal circuit board is communicatively coupled to a communication connector of the receptacle assembly.

In a further embodiment, a pluggable module is provided including a pluggable body extending between a mating end and a cable end. The pluggable body has a first end and an opposite second end with sides extending therebetween along a length of the pluggable body. The first end, second end and sides define a cavity. The pluggable body includes a plurality of fins extending outward from at least one of the first end, the second end and the sides. Channels are defined between the fins. The fins are provided at the cable end of the pluggable body such that the fins allow airflow along the length of the pluggable body to an exterior environment beyond the cable end. The pluggable body has grid fins extending across the channels between adjacent fins. The grid fins are provided at a positon aligned with a faceplate through which the pluggable module is plugged. The pluggable module includes an internal circuit board held in the cavity. The internal circuit board is provided at an end of a cable communicatively coupled to the internal circuit board. The pluggable body is configured to be plugged into a receptacle assembly such that the internal circuit board is communicatively coupled to a communication connector of the receptacle assembly.

In a further embodiment, a communication system is provided including a pluggable module and a receptacle assembly. The pluggable module includes a pluggable body extending between a mating end and a cable end. The pluggable body has a first end and an opposite second end with sides extending therebetween along a length of the pluggable body. The first end, second end and sides define a cavity. The pluggable body has a plurality of fins extending outward from at least one of the first end, the second end and the sides. Channels are defined between the fins. The pluggable body has grid fins extending across the channels between adjacent fins. The pluggable module has an internal circuit board held in the cavity. The internal circuit board is provided at an end of a cable communicatively coupled to the internal circuit board. The receptacle assembly has a receptacle housing defining a module cavity with a port opening at a front end of the receptacle housing open to the module cavity. The front end of the receptacle housing is configured to be positioned within an opening of a faceplate. The module cavity receives the pluggable module through the port opening. The receptacle assembly has a communication connector within the receptacle housing at a rear end of the receptacle housing. The pluggable module is pluggably coupled to the communication connector such that the internal circuit board is communicatively coupled to the communication connector. The grid fins are positioned proximate to the front end such that the grid fins reduce electromagnetic interference (EMI) through the channels proximate to the front end.

DETAILED DESCRIPTION OF THE INVENTION

Embodiments set forth herein include communication systems and pluggable modules of the same. The pluggable module provides significant thermal heat transfer for the components thereof. Various embodiments of the pluggable module include a pluggable body having a cost effective design. Various embodiments of the pluggable module include a pluggable body that facilitates heat transfer. Various embodiments of the communication system include heat sink inserts that guide loading of the pluggable module into a corresponding receptacle assembly and that transfer heat away from the pluggable module body.

Unlike conventional pluggable modules that utilize riding heat sinks that are held by a receptacle assembly and that interface with a flat upper surface of the pluggable module, embodiments set forth herein have fins integral with the pluggable module body that transfer heat therefrom. The fins may have air channels therebetween that are open and allow air to flow along the fins to cool the pluggable modules. In various embodiments, the channels may receive rails of a heat sink insert to allow direct thermal connection to the pluggable module by the heat sink to draw heat away from the pluggable module body to cool the pluggable module.

Figure 1:
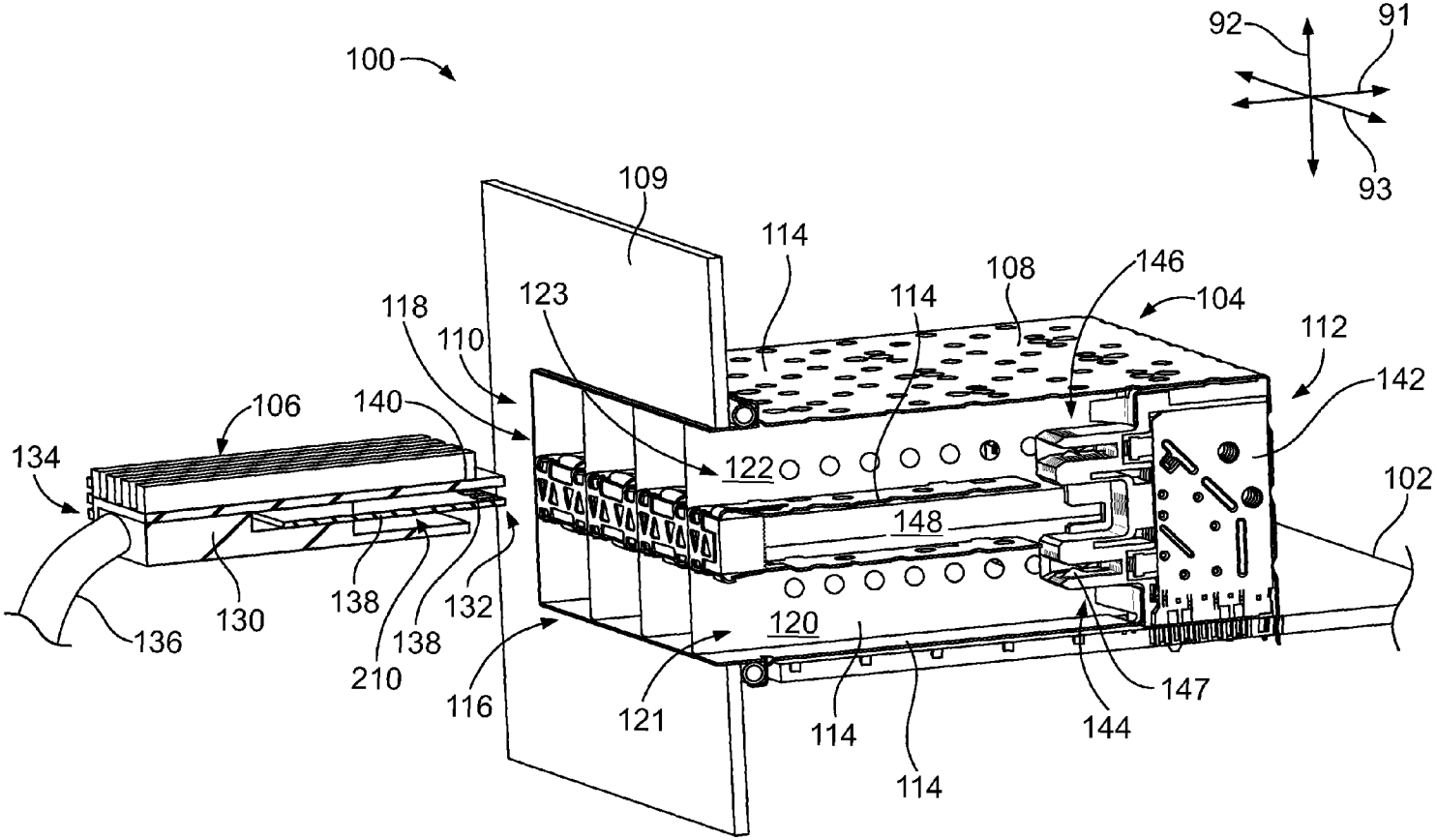
FIG. 1 is a perspective cross-sectional view of a communication system in accordance with an embodiment.

FIG. 1 is a perspective cross-sectional view of a communication system 100 in accordance with an embodiment. The communication system 100 may include a circuit board 102, a receptacle assembly 104 mounted to the circuit board 102, and one or more pluggable modules 106 that are configured to communicatively engage the receptacle assembly 104. The communication system 100 is oriented with respect to a mating or insertion axis 91, an elevation axis 92, and a lateral axis 93. The axes 91-93 are mutually perpendicular. Although the elevation axis 92 appears to extend in a vertical direction parallel to gravity in FIG. 1, it is understood that the axes 91-93 are not required to have any particular orientation with respect to gravity. Moreover, only one pluggable module 106 is shown in FIG. 1, but it is understood that multiple pluggable modules 106 may simultaneously engage the receptacle assembly 104.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate 109 of a chassis of the system or device, such as through an opening in the faceplate 109. As such, the receptacle housing 108 is interior of the device and corresponding faceplate 109 and the pluggable module(s) 106 is loaded into the receptacle housing 108 from outside or exterior of the device and corresponding faceplate 109.

The receptacle housing 108 includes a front end 110 and an opposite back end 112. The front end 110 may be provided at, and extend through an opening in, the faceplate 109. The mating axis 91 may extend between the front and back ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The receptacle housing 108 is configured to contain or block electromagnetic interference (EMI) and guide the pluggable module(s) 106 during a mating operation. To this end, the receptacle housing 108 includes a plurality of housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. The air may flow from inside the receptacle housing 108 (for example, behind the faceplate 109) to the external environment (for example, forward of the faceplate 109) or from outside the receptacle housing 108 into the interior of the receptacle housing 108. Fans or other air moving devices may be used to increase airflow through the receptacle housing 108 and over the pluggable module(s) 106.

In the illustrated embodiment, the receptacle housing 108 includes a first (or bottom) row 116 of elongated module cavities 120 and a second (or top) row 118 of elongated module cavities 122. Each of the module cavities 120, 122 extends between the front and back ends 110, 112. The module cavities 120, 122 have respective port openings 121, 123 that are sized and shaped to receive a corresponding pluggable module 106. The module cavities 120, 122 may have the same or similar dimensions and extend lengthwise in a direction that is parallel to the mating axis 91. In the illustrated embodiment, each module cavity 122 is stacked over a corresponding module cavity 120 such that the module cavity 120 is positioned between the module cavity 122 and the circuit board 102. Any number of module cavities may be provided including a single module cavity.

In some embodiments, the pluggable module 106 is an input/output cable assembly having a pluggable body 130. The pluggable body 130 includes a mating end 132 and an opposite cable end 134. A cable 136 is coupled to the pluggable body 130 at the cable end 134. The pluggable body 130 also includes an internal circuit board 138 that is communicatively coupled to electrical wires or optical fibers (not shown) of the cable 136. The cable 136 may be communicatively coupled by directly terminating the wires to the internal circuit board 138, such as by soldering the wires to the internal circuit board. Alternatively, the cable 136 may be communicatively coupled by other processes, such as by using connectors at the end of the cable 136 and on the internal circuit board 138. The internal circuit board 138 is supported by the pluggable body 130. The circuit board 138 includes contact pads 140 at the mating end 132. In FIG. 1, the mating end 132 is configured to be inserted into the module cavity 122 of the receptacle housing 108 and advanced in a mating direction along the mating axis 91. In an exemplary embodiment, the pluggable body 130 provides heat transfer for the internal circuit board 138, such as for the electronic components on the internal circuit board 138. For example, the internal circuit board 138 is in thermal communication with the pluggable body 130 and the pluggable body 130 transfers heat from the internal circuit board 138. In an exemplary embodiment, the heat is transferred from at or near the mating end 132, such as where various electrical components are located on the internal circuit board 138, to the cable end 134. The heat is pulled out of the receptacle assembly 104 and mating end 132 and rejected to the external environment forward of the faceplate 109. In other embodiments, the heat may be drawn into other portions of the pluggable body 130 and/or the heat may be directed to other portions of the pluggable body 130, such as to the mating end 132 where the heat may be transferred to another heat sink or heat transferring component inside the chassis.

The receptacle assembly 104 includes a communication connector 142 having first and second mating interfaces 144, 146. The first mating interface 144 is disposed within the module cavity 120, and the second mating interface 146 is disposed within the module cavity 122. The first and second mating interfaces 144, 146 are aligned with the port openings 121, 123, respectively. Each of the first and second mating interfaces 144, 146 includes respective electrical contacts 145, 147 that are configured to directly engage the contact pads 140 of the pluggable module 106. Thus, a single communication connector 142 may mate with two pluggable modules 106.

In alternative embodiments, the receptacle assembly 104 does not include the stacked module cavities 120, 122 and, instead, includes only a single row of module cavities 120 or only a single module cavity 120. In such embodiments, the communication connector 142 may have a single row of mating interfaces or a single mating interface.

The pluggable module 106 is an input/output (I/O) module configured to be inserted into and removed from the receptacle assembly 104. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

Also shown in FIG. 1, the housing walls 114 of the receptacle housing 108 also form a separator plate 148 between the module cavities 120, 122. The separator plate 148 extends generally parallel to the mating axis 91 between the front end 110 and the back end 112. More specifically, the module cavity 120, the separator plate 148, and the module cavity 122 are stacked along the elevation axis 92. Optionally, a light-indicator assembly (not shown), such as a light pipe may be provided in the separator cavity defined by the separator plate 148. The separator cavity may allow airflow between the module cavities 120, 122 to enhance heat transfer from the pluggable modules 106 located in the module cavities 120, 122.

Figure 2:
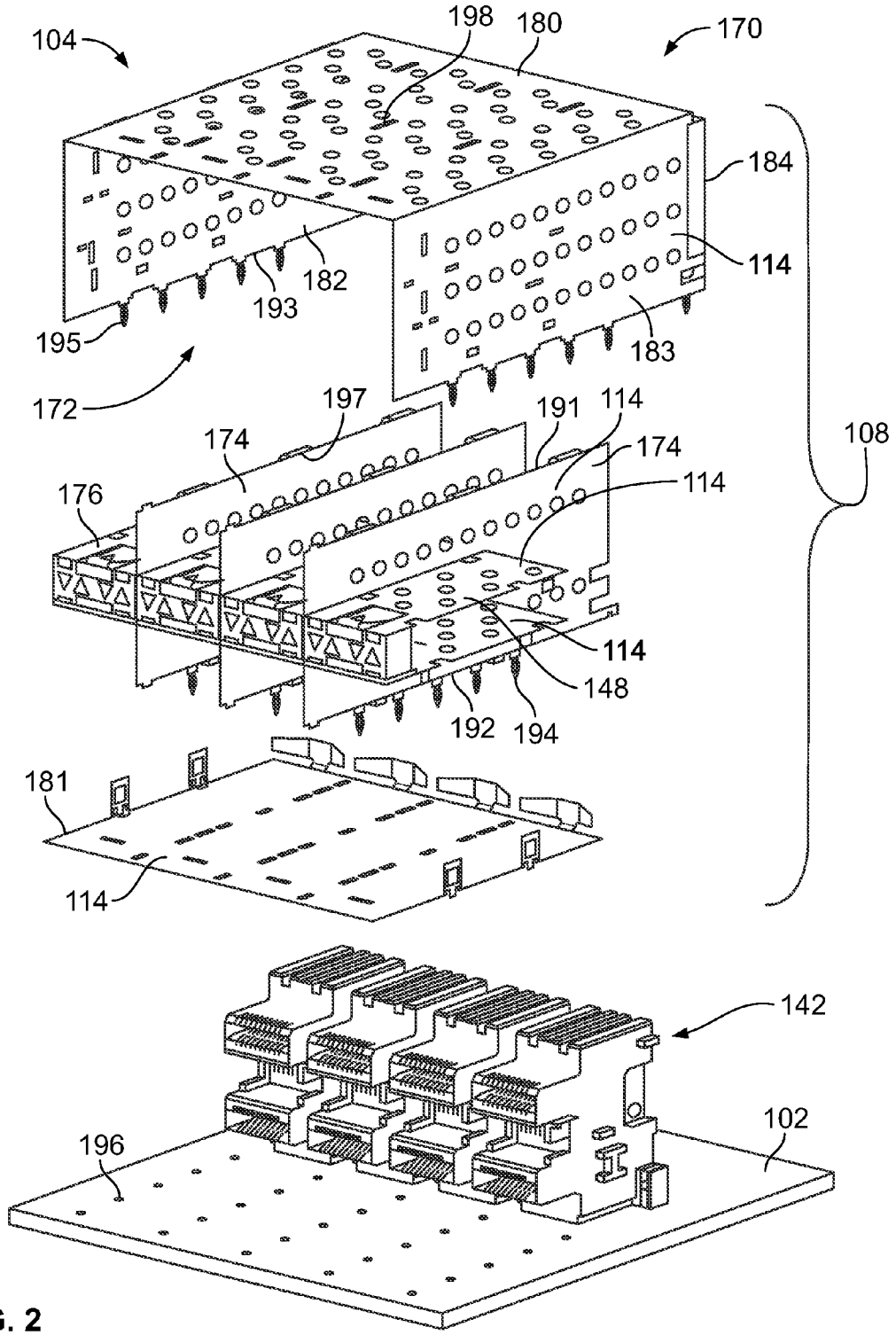
FIG. 2 is a partially exploded view of a receptacle assembly of the communication system shown in FIG. 1.

FIG. 2 is a partially exploded view of the receptacle assembly 104 and illustrates the receptacle housing 108 and a plurality of the communication connectors 142 mounted to the circuit board 102. In some embodiments, the receptacle housing 108 is formed from a plurality of interconnected panels or sheets. For example, the receptacle housing 108 includes a main panel or shell 170 that surrounds a housing cavity 172, a plurality of interior panels 174, a base panel 181, and separator panels 176 defining the separator plate 148. Each of the main panel 170, the interior panels 174, and the separator panels 176 may be stamped and formed from sheet metal. As described in greater detail below, each of the main panel 170, the interior panels 174, and the separator panels 176 may form one or more of the housing walls 114 that define the module cavity 120, the module cavity 122, and the separator plate 148 as shown in FIG. 1. As shown in FIG. 2, the main panel 170 includes an elevated wall 180, sidewalls 182, 183, and a back wall 184. The elevated wall 180 is located furthest from the circuit board 102 when the receptacle assembly 104 is constructed. The base panel 181 may rest on the circuit board 102. The sidewalls 182, 183 and the back wall 184 are configured to extend from the circuit board 102, when mounted thereto, to the elevated wall 180.

The interior panels 174 and the separator panels 176 are configured to be positioned within the housing cavity 172. Within the main panel 170, the interior panels 174 and the separator panels 176 apportion or divide the housing cavity 172 into the separate module cavities 120, 122 (FIG. 1) and the separator cavity of the separator plate 148 (FIG. 1).

In the illustrated embodiment, each of the interior panels 174 has a panel edge 191 that interfaces with the elevated wall 180 and a panel edge 192 that interfaces with the base panel 181 and/or the circuit board 102. The panel edge 192 may include mounting pins or tails 194 that are configured to mechanically engage and electrically couple to vias or thru-holes 196 of the circuit board 102. The panel edge 191 may include tabs or latches 197 that are configured to be inserted through slots 198 of the elevated wall 180 to couple to the elevated wall 180. Likewise, the sidewalls 182, 183 and the back wall 184 may have panel edges 193 that include mounting pins or tails 195 configured to mechanically engage and electrically couple to corresponding vias 196 of the circuit board 102.

The main panel 170, the base panel 181, the interior panels 174, and the separator panels 176 may comprise conductive material, such as metal or plastic. When the receptacle housing 108 is mounted to the circuit board 102, the receptacle housing 108 and the receptacle assembly 104 are electrically coupled to the circuit board 102 and, in particular, to ground planes (not shown) within the circuit board 102 to electrically ground the receptacle housing 108 and the receptacle assembly 104. As such, the receptacle assembly 104 may reduce EMI leakage that may negatively affect electrical performance of the communication system 100 (FIG. 1).

Figure 3:
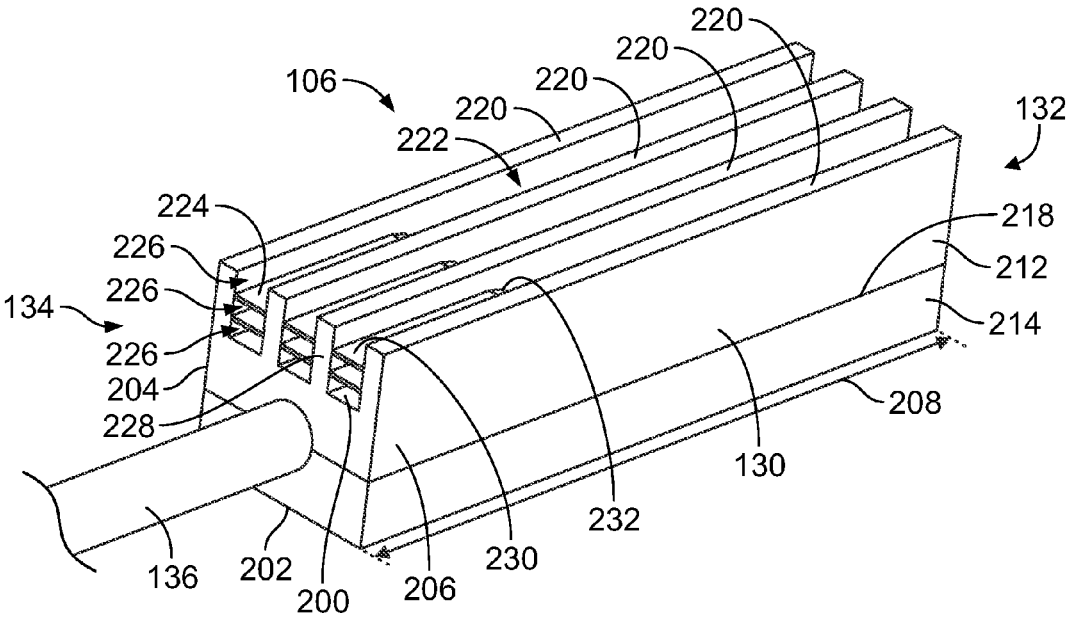
FIG. 3 is a perspective view of a pluggable module of the communication system formed in accordance with an exemplary embodiment.
Figure 4:
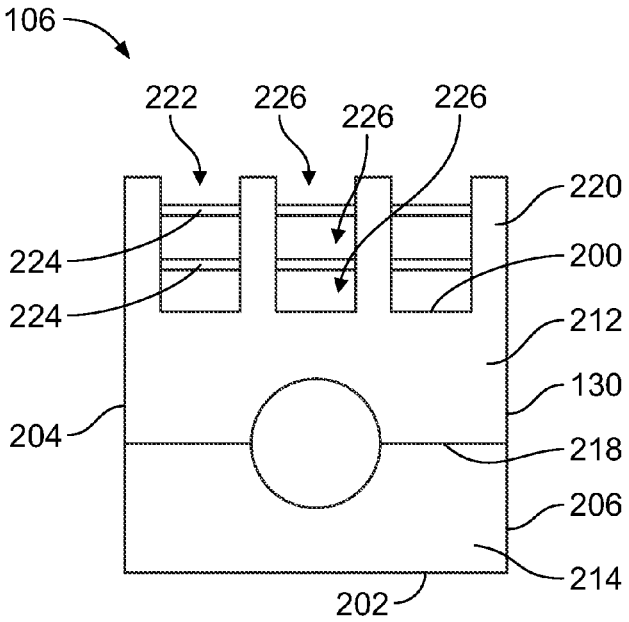
FIG. 4 is a front view of the pluggable module in accordance with an exemplary embodiment.

FIG. 3 is a perspective view of the pluggable module 106 in accordance with an exemplary embodiment. FIG. 4 is a front view of the pluggable module 106 in accordance with an exemplary embodiment. The pluggable body 130 holds the internal circuit board 138 (shown in FIG. 1). The pluggable body 130 has a first end 200 and an opposite second end 202 with sides 204, 206 extending between the first and second ends 200, 202. The first and second ends 200, 202 and the sides 204, 206 extend lengthwise along a length 208 of the pluggable body 130 between the mating end 132 and cable end 134. The first end 200, second end 202 and sides 204, 206 define a cavity 210 (shown in FIG. 1) that holds the internal circuit board 138. Optionally, the internal circuit board 138 may be exposed at the mating end 132 for mating with the corresponding communication connector 142 (shown in FIG. 2).

In an exemplary embodiment, the pluggable body 130 includes a first shell 212 and a second shell 214. Optionally, the first shell 212 may define an upper shell and may be referred to hereinafter as upper shell 212. The second shell 214 may define a lower shell and be referred to hereinafter as lower shell 214. The upper shell 212 includes the first end 200, which defines an upper end or top of the pluggable body 130. The lower shell 214 includes the second end 202, which may define a lower end or bottom of the pluggable body 130. In an exemplary embodiment, the sides 204, 206 are defined by both the upper shell 212 and the lower shell 214. However, in alternative embodiments, the upper shell 212 may define the sides 204, 206, or alternatively, the lower shell 214 may define the sides 204, 206. Optionally, the upper and lower shells 212, 214 may define approximately equal portions of the sides 204, 206. Alternatively, either the upper shell 212 or the lower shell 214 may define a significant majority of the sides 204, 206.

The internal circuit board 138 is arranged at or near a center plane of the pluggable module 106, which may be centered between the first and second ends 200, 202. Optionally, the upper and lower shells 212, 214 may meet at or near the center plane. A seam 218 may be defined at the interface between the upper and lower shells 212, 214.

In an exemplary embodiment, the upper shell 212 is used for heat transfer from the internal circuit board 138. The upper shell 212 is placed in thermal communication with the internal circuit board 138. Heat generated by the internal circuit board 138 is drawn into the upper shell 212 and transferred therefrom. In an exemplary embodiment, the upper shell 212 includes a plurality of fins 220 extending therefrom. The fins 220 increase the surface area of the upper shell 212 and allow more efficient heat transfer from the upper shell 212. The fins 220 may extend from any portion of the upper shell 212. In various embodiments, the fins 220 extend from the top or first end 200; however the fins 220 may extend from the second end 202 and/or the sides 204, 206. The fins 220 run lengthwise between the cable end 134 and the mating end 132. Optionally, the fins 220 may run substantially the entire length from the cable end 134 to the mating end 132. In the illustrated embodiment, the fins 220 are parallel plates.

The fins 220 are separated by channels 222. Optionally, the channels 222 may have a uniform spacing between the fins 220. For example, sides of the fins 220 may be planar and parallel. The fins 220 and channels 222 may extend along the length of the pluggable body 130 such that the channels 222 are open at the cable end 134 and/or the mating end 132 to allow air to flow along the fins 220, such as from the cable end 134 toward the mating end 132 or from the mating end 132 toward the cable end 134. In various embodiments, the channels 222 may be shaped or contoured, such as to encourage airflow therethrough. For example, the fins 220 may be shaped like an airfoil to increase airflow through the channels 222. Optionally, the channels 222 may receive portions of a heatsink to encourage heat transfer from the pluggable body 130.

In an exemplary embodiment, the upper shell 212 includes grid fins 224 extending across the channels 222 between adjacent fins 220. The grid fins 224 are electrically conductive and electrically coupled to the fins 220. The grid fins 224 reduce the size of the channels 222 to reduce EMI leakage through the channels 222. For example, while it may be desirable to have large channels 222 to increase air movement across the fins 220, such large channels 222 may be susceptible to EMI, which may degrade the signals transmitted by the pluggable module 106. The grid fins 224 reduce the size of the channels 222 to block lower frequency EMI while still allowing a large amount of air flow through the channels 222. In an exemplary embodiment, multiple grid fins 224 are provided in each channel 222 to reduce the size of the channels 222 by more than 50%.

The grid fins 224 divide the channels 222 into sub-channels 226. For example, the sub-channels 226 may be defined both above and below each of the grid fins 224. In an exemplary embodiment, the grid fins 224 are oriented perpendicular to the fins 220. For example, the fins 220 may be oriented approximately vertically and the grid fins 224 may be oriented approximately horizontally.

Optionally, the grid fins 224 may be integral with the fins 220 and pluggable body 130. For example, the upper shell 212 may be die cast, extruded, molded, or formed by other processes with the grid fins 224 integral and unitary with the fins 220. Alternatively, the grid fins 224 may be separately manufactured and provided from the fins 220 and then coupled thereto. For example, the grid fins 224 may be soldered, welded, adhered, friction fit or otherwise mechanically and electrically coupled to the fins 220. Optionally, the grid fins 224 may be thinner than the fins 220. The fins 220 may be thicker for structural integrity, while the grid fins 224 may be thinner to allow as much air flow through the channels 222 as possible.

In an exemplary embodiment, the grid fins 224 do not extend the entire length of the fins 220; however in various embodiments the grid fins 224 may extend the entire length of the fins 220. Optionally, the grid fins 224 may not be continuous along the length of the fins 220. Alternatively, such discontinuous grid fins 224 may tie the fins 220 together at regular intervals along the length of the fins 220. Optionally, the tie points of the grid fins 224 may be staggered, as opposed to being aligned, as in the illustrated embodiment. For example, the grid fins 224 in one channel 222 may be at a different height as compared to the grid fins 224 in a different channel 222. The area of the upper shell 212 that is most susceptible to EMI is at the opening in the receptacle assembly 104 and/or the faceplate 109 (both shown in FIG. 1) because other portions of the upper shell 212 are surrounded by the receptacle housing, which provides some protection from EMI. As such, in an exemplary embodiment, the grid fins 224 are located proximate to exterior ends 228 of the fins 220. The grid fins 224 may be positioned at a location along the fins 220 generally aligned with the exit point of the pluggable body 130 from the receptacle assembly.

The grid fins 224 extend between a front end 230 and a rear end 232. Optionally, the grid fins 224 may be planar between the front and rear ends 230, 232 and extend generally parallel to the first end 200 of the pluggable body 130. Alternatively, the grid fins 224 may be contoured and non-planar. The grid fins 224 may be angled inward toward the pluggable body 130 at the rear end 232, which may direct the airflow in the associated sub-channel 226 inward toward the first end 200 to enhance cooling of the pluggable body 130. Optionally, the grid fins 224 may have different lengths, such as with the upper-most grid fin being the longest and the lower-most grid fin being the shortest for directing airflow toward the first end 200. The grid fins 224 may be airfoil shaped to encourage or increase airflow through the sub-channels 226. The shapes of the grid fins may direct airflow in particular ways through the channels 222.

Having the upper shell 212 comprise a plurality of the fins 220 allows more heat to be transferred by the upper shell 212 than with conventional pluggable body shells. The grid fins 224 control EMI through the channels 222, allowing the channels 222 to be open at the cable end 134 for airflow into or out of the receptacle assembly through the channels 222. Conventional pluggable body shells are typically solid at the cable end where the pluggable module interfaces with the receptacle assembly. A gasket is typically provided at the port opening to ensure the opening is sealed from EMI. Conventional pluggable body shells do not include channels or openings at the cable end. However, the upper shells 212 of the pluggable bodies 130 will provide improved heat transfer, as compared to conventional pluggable modules. More efficient heat transfer is achieved using the upper shell 212 with the fins 220 and channels 222 for airflow as compared to conventional shells of conventional pluggable bodies.

In an exemplary embodiment, the upper shell 212 is fabricated from a material having a high thermal conductivity. For example, the upper shell 212 may be manufactured from copper or aluminum. Using a material having a high thermal conductivity allows more efficient heat transfer from the internal circuit board 138. In an exemplary embodiment, the upper shell 212 may be manufactured by an extrusion process such that the upper shell 212 includes an extruded body; however the upper shell may be manufactured by other processes in alternative embodiments, such as a die casting process, a machining process, a stamp and forming process of a sheet metal body, a layering build-up process, such as 3D printing, or another process. Extruding the upper shell 212 is a less expensive manufacturing process than some other processes, such as machining Additionally, extrusion is a process that may be used on materials having high thermal conductivity. For example, some other processes, such as die casting, require additives or impurities in some materials, such as aluminum, which lowers the thermal conductivity of such material. Additionally, the porosity of the material from die casting may be higher, leading to a lower thermal conductivity of the material. As such, shells made by such die casting may be less effective at heat transfer than shells made from extrusion. The extrusion process creates a simple structure having generally flat walls or surfaces. The fins 220 may be easily extruded with the other portions of the upper shell 212. The upper shell 212 has a generally uniform cross-section along the length 208, even including the fins 220. The grid fins 224 may be extruded with the fins 220 or may be insert during a later assembly process.

The lower shell 214 may be manufactured in a similar manner as the upper shell 212. The lower shell 214 may include fins (not shown). In contrast, in various embodiments, the lower shell 214 may be manufactured differently than the upper shell 212. For example, substantially all of the heat from the internal circuit board 138 may be drawn into the upper shell 212 as opposed to the lower shell 214. The upper shell 212 may thus be designed to achieve significant heat transfer. The lower shell 214, in contrast, may be designed to achieve other advantages. For example, in various embodiments, because the upper shell 212 is extruded, such as to reduce cost of manufacturing the upper shell 212 and/or to provide a material having better heat transfer, the upper shell 212 may have a simple design, such as a substantially uniform cross-section. Because the upper shell 212 does not include robust assembly features, the lower shell 214 may have a more complex design as compared to the upper shell 212. The complex design may require die casting or machining to form the various features needed. For example, the body of the lower shell 214 may have supporting features, alignment features, guide features and/or connection features for the internal circuit board 138 and/or for coupling the upper shell 212 to the lower shell 214. For example, the body may include one or more pockets that receive various electrical components of the internal circuit board 138. The body may include supporting elements for supporting the internal circuit board 138. The body may include alignment elements for aligning the internal circuit board 138 within the cavity 210 and/or for aligning the upper shell 212 with the lower shell 214 for connection thereto. The body may include securing features used for securing the upper shell 212 to the lower shell 214. For example, the securing features may include threaded bores that receive threaded fasteners to secure the upper shell 212 to the lower shell 214. Other types of securing features may be provided in alternative embodiments, such as latches, clips, and the like for securing the upper shell 212 to the lower shell 214. The body may include a cable support for supporting and/or aligning the cable 136 with the body.

The lower shell 214 may be manufactured from any type of material, such as a material that may be readily die cast. For example, the lower shell 214 may be manufactured from zinc, which is an easy metal to cast as zinc has high ductility, high impact strength and lower costs than other metals.

Figure 5:
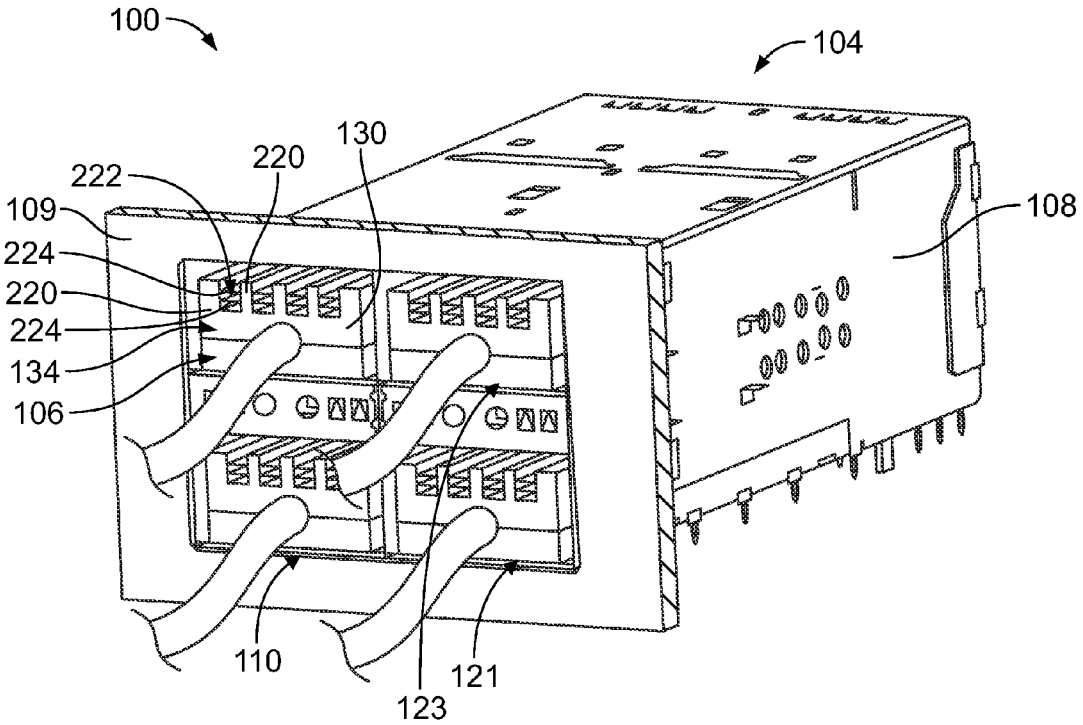
FIG. 5 is a front perspective view of the communication system showing the pluggable modules loaded in the receptacle assembly.

FIG. 5 is a front perspective view of the communication system 100 showing the pluggable modules 106 loaded in the receptacle assembly 104. The receptacle assembly 104 passes through an opening in the faceplate 109 to a position rearward of the faceplate 109 such that the receptacle assembly 104 is interior of or inside the device having the faceplate 109. In an exemplary embodiment, the faceplate 109 is conductive, such as a metal plate or bezel. The receptacle assembly 104 is electrically connected to the faceplate 109, such as using one or more gaskets. The electrical connection at the interface between the faceplate 109 and the receptacle housing 108 reduces EMI at the interface.

In an exemplary embodiment, the fins 220 extend to the cable ends 134 of the pluggable bodies 130 such that the channels 222 are open to the external environment forward of the faceplate 109. The fins 220 are positioned along the pluggable body 130 such that the fins 220 are exposed at the port openings 121, 123 of the receptacle assembly 104. The fins 220 may extend from inside the receptacle assembly 104 to outside of the receptacle assembly 104, such as beyond the front end 110. The fins 220 may extend beyond or forward of the faceplate 109 in various embodiments. Having the fins 220 extend to the cable ends 134 allows the channels 222 to facilitate airflow between the internal environment and the external environment of the device having the faceplate 109. For example, air is able to flow through the channels 222 from inside the receptacle assembly 104, and is exhausted forward of the faceplate 109, which cools the fins 220 and the pluggable body 130. Alternatively, cool air is able to flow from outside of the receptacle assembly 104 through the channels 222 into the receptacle assembly 104 to cool the fins 220 and the pluggable body 130.

The grid fins 224 may be provided at the cable ends 134 of the pluggable bodies 130, such as at the front ends of the fins 220. The grid fins 224 are positioned along the fins 220 such that the grid fins 224 are aligned with the receptacle housing 108 at the port openings 121, 123 of the receptacle assembly 104. The grid fins 224 may extend from inside the receptacle assembly 104 to outside of the receptacle assembly 104, such as beyond the front end 110. The grid fins may extend from exterior portions of the fins 220, which are located exterior of the receptacle assembly 104, to interior portions of the fins 220, which are located interior of the receptacle assembly 104. The grid fins 224 may extend beyond or forward of the faceplate 109 in various embodiments. Having the grid fins 224 aligned with the faceplate 109 and the front end 110 provides EMI protection through the port openings 121, 123 to reduce EMI leakage into and out of the receptacle housing 108. Air is able to flow through the channels 222 with little restriction from the grid fins 224.

Figure 6:
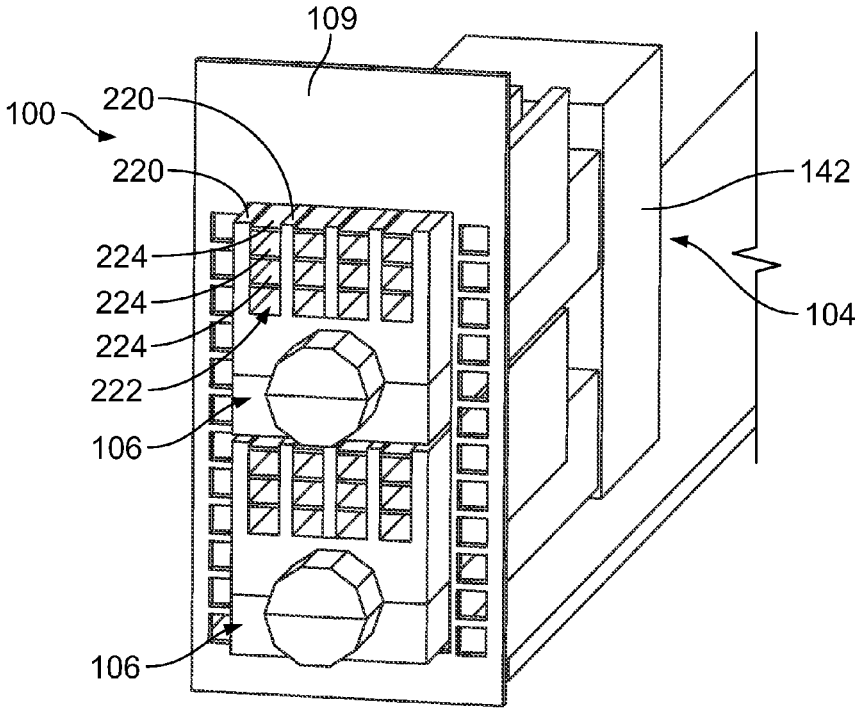
FIG. 6 is a front perspective view of the communication system showing the pluggable modules in accordance with an exemplary embodiment loaded in the receptacle assembly.

FIG. 6 is a front perspective view of the communication system 100 showing the pluggable modules 106 in accordance with an exemplary embodiment loaded in the receptacle assembly 104. The housing walls of the receptacle housing are not shown in FIG. 6 for clarity to show the pluggable modules 106 mated with the communication connector 142. The receptacle assembly 104 is provided without the separator plates 148 (shown in FIG. 1). Rather, the lower pluggable module 106 has taller fins 220 extending into the space otherwise used by the separator plates 148 to transfer more heat. The upper pluggable module 106 also has taller fins 220 and the housing walls of the receptacle housing may accommodate the taller fins 220. The pluggable modules 106 have additional grid fins 224 to accommodate the taller channels 222.

Optionally, the upper pluggable module 106 may rest on the lower pluggable module 106. Heat may be transferred from the lower pluggable module into the upper pluggable module 106 at the locations where the fins 220 of the lower pluggable module 106 engage the upper pluggable module 106.

The grid fins 224 are aligned with the faceplate 109. The grid fins 224 extend from outside of the receptacle assembly 104 to inside of the receptacle assembly 104. The grid fins 224 reduce EMI leakage into and/or out of the receptacle assembly 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable module comprising:

a pluggable body extending between a mating end and a cable end, the pluggable body having a first end and an opposite second end with sides extending therebetween along a length of the pluggable body, the first end, the second end and the sides defining a cavity, the pluggable body including a plurality of fins extending outward from at least one of the first end, the second end and the sides, channels being defined between the fins allowing airflow along the pluggable body, the pluggable body having grid fins extending across the channels between adjacent fins to define an outer sub-channel exterior of the grid fin allowing airflow exterior of the grid fin and an inner sub-channel interior of the grid fin allowing airflow interior of the grid fin; and an internal circuit board held in the cavity, the internal circuit board being provided at an end of a cable communicatively coupled to the internal circuit board, wherein the pluggable body is configured to be plugged into a receptacle assembly such that the internal circuit board is communicatively coupled to a communication connector of the receptacle assembly.

2. The pluggable module of claim 1, wherein the grid fins are spaced apart from the corresponding first end, second end or side from which the associated fins extend to divide the channel into the upper and lower sub-channels.

3. The pluggable module of claim 1, wherein the grid fins are oriented perpendicular to the fins.

4. The pluggable module of claim 1, wherein the grid fins are integral with the fins.

5. The pluggable module of claim 1, wherein the grid fins are separately provided from, and coupled to, the fins.

6. The pluggable module of claim 1, wherein the fins and the grid fins are electrically conductive and electrically coupled together.

7. The pluggable module of claim 1, wherein the grid fins reduce electromagnetic interference (EMI) leakage through the channels.

8. The pluggable module of claim 1, wherein the grid fins are located proximate to an exterior end of the fins.

9. The pluggable module of claim 1, wherein the grid fins are positioned at a location along the fins configured to be generally aligned with an exit point of the pluggable body from the receptacle assembly.

10. The pluggable module of claim 1, wherein the grid fins extend from exterior portions of the fins configured to be located exterior of the receptacle assembly to interior portions of the fins configured to be located interior of the receptacle assembly.

11. The pluggable module of claim 1, wherein multiple grid fins are provided in each channel.

12. The pluggable module of claim 1, wherein the grid fins extend between a front end and a rear end, the grid fins being angled inward toward the pluggable body at the rear end.

13. The pluggable module of claim 1, wherein each channel includes at least one of the grid fins.

14. The pluggable module of claim 1, wherein the grid fins are oriented generally parallel to the first end of the pluggable body.

15. The pluggable module of claim 1, wherein the grid fins are thinner than the fins.

16. A pluggable module comprising:

a pluggable body extending between a mating end and a cable end, the pluggable body having a first end and an opposite second end with sides extending therebetween along a length of the pluggable body, the first end, the second end and the sides defining a cavity, the pluggable body including a plurality of fins extending outward from at least one of the first end, the second end and the sides, channels being defined between the fins, the fins being provided at the cable end of the pluggable body such that the fins allow airflow along the length of the pluggable body to an exterior environment beyond the cable end, the pluggable body having grid fins extending across the channels between adjacent fins and being spaced apart from the corresponding first end, second end or side from which the associated fins extend, the grid fins being provided at a positon aligned with a faceplate through which the pluggable module is plugged; and an internal circuit board held in the cavity, the internal circuit board being provided at an end of a cable communicatively coupled to the internal circuit board, wherein the pluggable body is configured to be plugged into a receptacle assembly such that the internal circuit board is communicatively coupled to a communication connector of the receptacle assembly.

17. A communication system comprising:

a pluggable module comprising a pluggable body extending between a mating end and a cable end, the pluggable body having a first end and an opposite second end with sides extending therebetween along a length of the pluggable body, the first end, the second end and the sides defining a cavity, the pluggable body having a plurality of fins extending outward from at least one of the first end, the second end and the sides, channels being defined between the fins, the pluggable body having grid fins extending across the channels between adjacent fins to at least divide the channels in half, and the pluggable module having an internal circuit board held in the cavity, the internal circuit board being provided at an end of a cable communicatively coupled to the internal circuit board; and a receptacle assembly having a receptacle housing defining a module cavity with a port opening at a front end of the receptacle housing open to the module cavity, the front end of the receptacle housing being configured to be positioned within an opening of a faceplate, the module cavity receiving the pluggable module through the port opening, the receptacle assembly having a communication connector within the receptacle housing at a rear end of the receptacle housing, the pluggable module being pluggably coupled to the communication connector such that the internal circuit board is communicatively coupled to the communication connector;

wherein the grid fins are positioned proximate to the front end such that the grid fins reduce electromagnetic interference (EMI) through the channels proximate to the front end.

18. The communication system of claim 17, wherein the grid fins are positioned at a location along the fins generally aligned with an exit point of the pluggable body from the receptacle assembly.

19. The communication system of claim 17, wherein the grid fins extend from exterior portions of the fins located exterior of the receptacle assembly to interior portions of the fins located interior of the receptacle assembly.

20. The communication system of claim 17, wherein multiple grid fins are provided in each channel to divide each channel into sub-channels.

* * * * *